United States Patent [19]

Karbstein

[11] Patent Number: 4,699,544

[45] Date of Patent: Oct. 13, 1987

[54] PROTECTIVE FRAME DEVICE FOR DRAINAGE CHANNEL

[75] Inventor: Peter Karbstein, Neumünster, Fed. Rep. of Germany

[73] Assignee: ACO Polymer Products, Inc., Chagrin Falls, Ohio

[21] Appl. No.: 904,448

[22] Filed: Sep. 8, 1986

Related U.S. Application Data

[62] Division of Ser. No. 795,953, Nov. 7, 1985, Pat. No. 4,630,966.

[30] Foreign Application Priority Data

Nov. 30, 1984 [DE] Fed. Rep. of Germany ... 8435101[U]

[51] Int. Cl.[4] ..... E01C 11/22

[52] U.S. Cl. ..... 405/118; 405/121; 404/2; 138/155

[58] Field of Search ..... 405/118, 119, 120, 121, 405/122, 123, 124, 125, 126; 52/11, 12, 13, 14, 15, 16; 138/166, 169, 155, 175; 404/2, 8

[56] References Cited

U.S. PATENT DOCUMENTS

| | | | |
|---|---|---|---|
| 1,602,327 | 10/1926 | Blanchard | 404/8 |
| 2,978,758 | 4/1961 | Dunn | 52/13 |
| 3,344,562 | 10/1967 | Miles et al. | 52/11 |
| 3,417,570 | 12/1968 | Pegan et al. | 405/119 |
| 4,105,353 | 8/1978 | Bórk et al. | 404/2 |
| 4,241,548 | 12/1980 | Rowe | 52/11 |
| 4,341,392 | 7/1982 | van Dongeren | 285/344 |
| 4,472,078 | 9/1984 | Karbstein | 405/119 |
| 4,616,450 | 10/1986 | Shouse | 52/12 |

*Primary Examiner*—Dennis L. Taylor
*Assistant Examiner*—Nancy J. Stodola
*Attorney, Agent, or Firm*—Beveridge, DeGrandi & Weilacher

[57] ABSTRACT

A drainage channel is shown which features a body having complementary ends which, in abutting relationship, form interlock with adjacent channel bodies when joining the channel bodies together; and an edge protective frame device for the upper free rims or edges of the channel side walls comprising a web resting on top of the channel side wall and two anchor legs extending downwards from and linked by the web and proceeding in the same direction and distance, at least one of which anchor legs is flush with its respective channel side wall and between the two of which legs the material of the upper part of the channel walls is formed; and a mounting leg for a channel cover, extending upwards from the outer edge of the web.

6 Claims, 8 Drawing Figures

FIG. 5
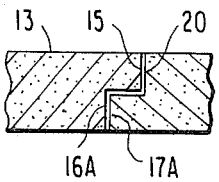
FIG. 6
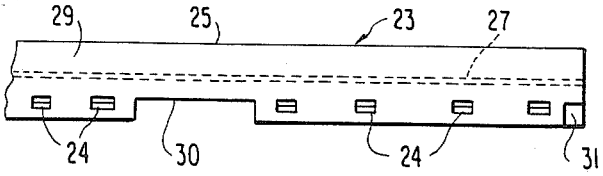
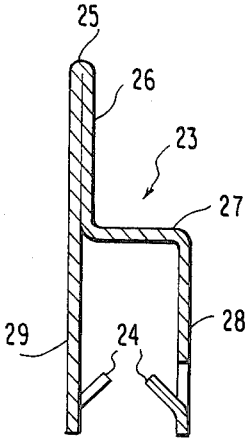
FIG. 7
FIG. 8
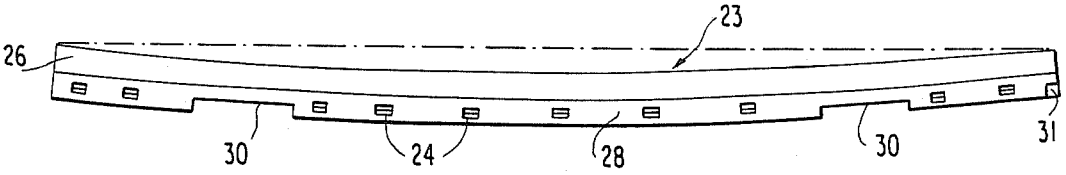

PROTECTIVE FRAME DEVICE FOR DRAINAGE CHANNEL

REFERENCE TO A RELATED APPLICATION

This is a divisional application based on my copending patent application Ser. No. 795,953 filed Nov. 7, 1985, now U.S. Pat. No. 4,630,966, which is relied on and incorporated herein by reference.

The present invention relates to a drainage channel, which features a body having complementary ends which, in abutting relationship, form-interlock with adjacent channel bodies when joining the channel bodies together; and an edge protective frame device for the upper free rims or edges of the channel side walls comprising a web resting on top of the channel side wall and two anchor legs extending downwards from and linked by the web and proceeding in the same direction and distance, at least one of which anchor legs being flush with its respective channel side wall, the space between the two legs accommodating the material of the upper part of the channel side walls; and a mounting leg for a channel cover, extending upwards from the outer edge of the web.

Drainage channels of a general design are known in the art; see DE-GM No. 71 22 579. The channel body with its U-shaped cross-section is molded from concrete or polymer concrete. The top edge protective frame device consists of a cast metal shaped part. The second anchor leg and the first anchor leg are positioned at an angle towards each other, thus the space between them has a dovetailed cross-section. Furthermore, the edge protective frame device is designed to hold a channel cover. While a firm junction between these parts is achieved by embedding the anchor leg, the cross-section of the channel wall, however, is reduced at its critical part (notch effect). This notch effect becomes particularly critical when relatively thin channel walls are desired.

Existing drainage channels have suitable abutting ends at their ends which are intended to form-interlock with adjacent channel members when joining the channel bodies. These abutting profiles prevent sideslipping of the channels. Furthermore, they provide a suitable transition for the water discharge. When installed, these channel bodies are interlocked by abutting them together.

It is also known from applicant's earlier issued U.S. Pat. No. 4,472,078 to form cast metal frames for drainage ditches wherein the frames have two downwardly pointing legs in parallel relation with several spaced recesses having projections between the recesses.

An object of the present invention is to create a drainage channel with lighter structural weight and good edge protection that is easy to install.

A feature in achieving the object of the invention resides in providing drainage channels wherein the abutting surface of the channel side walls have skewed or diagonal surface cut outs which are holohedrally placed together with the adjacent channel body. That is, the skewed cut out sections are so arranged to fit one into the other or mate with the adjacent channel body.

At one end of the channel body, the skewed surface sections form an inner cone or inwardly directed slanted surface, and at the opposite end of the channel body there is formed an outer cone or outwardly directed slanted surfaces. When joining the channel bodies together, the outwardly directed cone interlocks with and fits into the inwardly directed cone of an adjacent channel body and makes the channel bodies mate together. The bottom underneath surface of the channels and the interior U-shaped flow chamber of the channels may be of customary design. The end portions of the channels comprise a novel configuration in that there are abutting surfaces skewed in such a way that the bottom edge and the two opposite vertical side edges forming the "female" end of the channel unit receives and form interlocks with a protruding part of the adjacent abutting profile, where the protruding part of the said abutting adjacent profile is located about the inner edge of the U-shaped channel. Thus, the bottom edge portion of the female end fits underneath of the protruding male end and the protruding side edges of the female end fit up around the vertical side portions of the male end. Each channel body when placed in the desired location prevents the preceding one in the series of abutting channels from moving vertically upwards.

A feature of the present invention provides for the skewed sections at the one end of the channel to be positioned between two surfaces, which are at right angles to the channel body axis. The inner one of these skewed surfaces is set back from the outer one in the opposite flow direction. The skewed sections on the other end are sloped from the outside of the walls towards the front and the inside up to a surface vertical to the body axis and abutting against the inner surface of the next channel. By this means, the channel bodies are effectively centered under construction with the ones already laid and the installation is thereby facilitated.

In particular, the present invention relates to channel bodies of lighter structural weight and correspondingly thinner side walls. The conventional edge protective frame device of cast shaped parts used for channels of a heavier and thicker design is rather labor intensive and too heavy for the lighter weight channel models. An embodiment of the present invention, therefore, provides for an edge protective frame device made of formed sheet metal with one double layer mounting leg, and with the web and the inner anchoring leg attached to it. The outer anchoring leg preferably reaches downwards from the outer layer of the mounting leg. Both anchoring legs are embedded in the channel wall and surface and are flush with the inner and outer side of the channel wall. Preferably, the metal sheet consists of a simple sheet material with a folding section or double thickness at the upper rim of the mounting leg.

Such an edge protective frame device is easy to produce and requires little material. Nevertheless, it accomplishes an effective protection of the upper edges of the channel body and guarantees a secure mounting of the channel cover.

An additional feature for an effective anchorage of the edge protection device of the present invention is the provision of inner anchor tongues at the anchor legs, preferably punched out. Preferably they are tilted upwards and enter into the upper side walls of the channel. Such a sheet metal part can be easily manufactured. First the tongues are punched out. Then the sheet metal is bent and folded in its final shape to be inserted in the mold when casting the channel body. Of course, the anchor tongues can also be welded in place or shaped in another manner.

The present invention is explained and illustrated by the following drawings, wherein:

FIG. 5 is a cross-section profile of the butt-joint of FIG. 4 along cross-section line 5—5;

FIG. 6 is a side view of part of the edge protective frame device for the channel as shown in FIGS. 1 to 3 on a reduced scale;

FIG. 7 is a cross-section view of the edge protective frame device shown in FIG. 6; and FIG. 8 is a side view of the edge protective frame device shown in FIG. 6.

Figure 1:
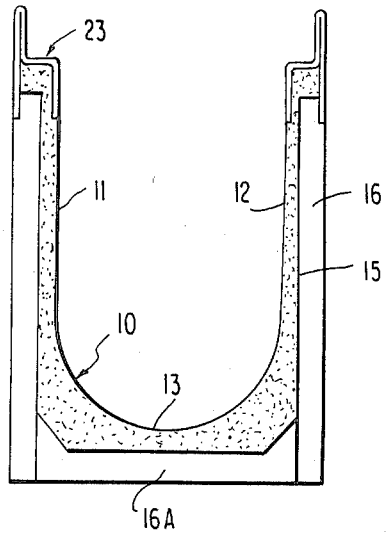
FIG. 1 is an end view of a drainage channel according to the invention.

Prior to describing the details of the invention as shown in the drawings it is to be noted that each of the described features either individually or in combination, as set forth in the claims, are considered to be applicant's invention.

Figure 2:
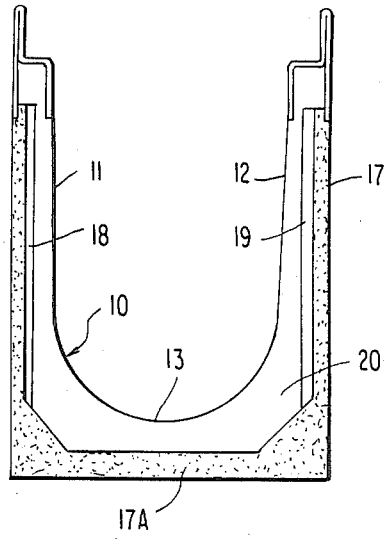
FIG. 2 is an end view of a drainage channel opposite to the end shown in FIG. 1.
Figure 3:
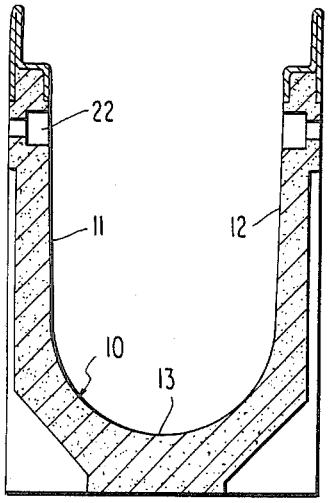
FIG. 3 is a cross-section of a drainage channel as shown in FIGS. 1 and 2.

The U-shaped channel body 10 as shown in FIGS. 1 to 3 has two essentially parallel side walls 11, 12, with a small angle or gradient at the inside so that they converge towards the bottom in the form of a U-shape. At their respective lower edges, the side walls merge into a channel trough section 13 having generally a semicircular cross-section. As evident from FIG. 1, one end of the channel has an inner, U-shaped protruding portion 15, the upper part of which extends all over the thickness of side walls 11 and 12. This protruding portion 15 is adapted to fit into or mate with the abutting end of an adjacent channel and to thereby form interlock with each other.

FIG. 1 also shows that the channel has formed at its end skewed surface 16, on each of the vertical wall sections and a recessed portion 16A located under the lower portion of the protruding section 15. Protective edge device 23 is also shown in FIG. 1.

In FIG. 2, there is shown the opposite end of the channel from that shown in FIG. 1. The channel end is configured to have a recessed or female portion 20 which is adapted to receive the protruding portion 15 of an adjacent abutting channel to form interlock therewith. FIG. 2 further shows that the female end of the channel has sloping or skewed surfaces 18 and 19 which extend from the end vertical surface 17 rearward towards the interior of the channel towards the recessed surface 20. In this way, the skewed surfaces 18 and 19 will be complementary to skewed surface 16 on mating surface of the adjacent channel.

FIG. 3 shows that two graduated openings 22; i.e. openings that have a relatively large diameter on the inside wall and which then narrow to a relatively smaller hole on the exterior surface, are each formed in reverse order into the side walls 11, 12 to mount a locking bolt of a channel cover which is not illustrated.

Figure 4:
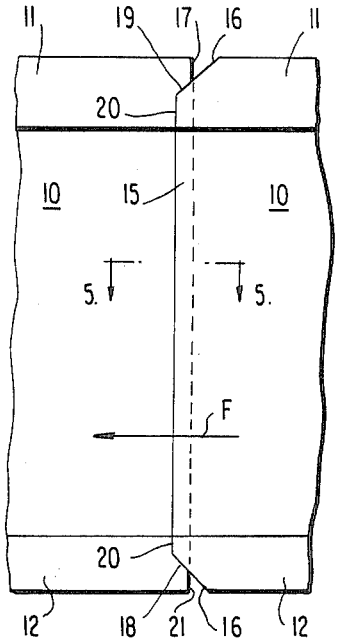
FIG. 4 is a top view of the butt-joint formed between two drainage channels, without the edge protection device being shown.

FIG. 4 shows the interlocking joint formed when two channels are placed in abutting relationship with the protruding portion 15 (shown at right) extending into and over the recessed portion 20 (shown at left) of the channel member 10.

FIG. 4 also shows that abutting part 16 is skewed in a direction that is outwardly from and away from the leading edge of the protruding portion 15 of the channel at the right, and is intended to be compatible with the complementary end shown in FIG. 2. The slope of the skewed section 16 extends from the protruding portion 15 towards the outside and opposite to the flow direction F (FIG. 4). At the opposite end of the mating channel shown at the left in FIG. 4, a U-shaped outer vertical surface part 17 protrudes. See also FIG. 2. As may be seen in FIG. 4, the channel at the left has skewed surface sections 18, 19, that are sloped or skewed towards the inside or interior of recessed surface 20 and terminate at the U-shaped inner abutting surface 20. Except for a small gap 21 in the area of both abutting ends of the channel walls, the described abutting skewed surface profiles are complementary and in contact. The skewed abutting surface sections 16 on the male or protruding end at the right and 18, 19 on the back or recessed end on the left may be described as cone like surface and being cones they may be placed together holohedrally; i.e. fit deeply into each other, to form a symetrical arrangement as is shown in FIG. 4. These cone-like surfaces cooperate together to produce a centering effect on the channel bodies 10 during joining to thereby assist in overall alignment and avoid leakage of the liquid contents that flows through the drainage channels. The flow direction is indicated by arrow F.

As is shown from the cross-section of FIG. 5, the channel bodies form interlock at their bottom parts by a groove and tongue joint formed by the lower section 16A under protruding portion 15 and the recessed surface 20 and the protruding surface 17A on the female end as shown at the right.

One edge protective frame device 23, the details of which are shown in FIGS. 6 to 8 is embedded in each of the channel walls 11, 12.

The edge protective frame device is a formed or stamped sheet metal bent in shape from a simple sheet metal blank. As shown in FIGS. 6 and 7, inward tilted tongues 24 are punched into the blank. After the tongues have been punched out, the blank is bent in a folded manner 25, thus creating a double layer mounting leg 26, at the inner layer of which a web 27 is beaded, from which, again an inner anchor leg 28 is crimped. The outer layer of the mounting leg 26 extends straight downwards, its lower part being the outer anchor leg 29.

From the bottom edge into the anchor legs 28 and 29 are also rectangular recesses, one of which is shown in FIG. 6 at 30. The recesses are located in accordance with the openings 22 which are formed into the channel walls.

As is evident from FIGS. 1 to 3, the anchor legs 28, 29 are embedded in the upper part of the side walls 11, 12, whereby the outsides of the anchor legs 28, 29 are flush with the inner and outer sides of the side walls 11, 12. The anchoring tongues 24 extend into the side walls. The web 27 is positioned on the upper surface of the side walls.

The edge protective frame is bowed along its longitudinal axis with the ends of the edge protective frame 23 higher than the center, as viewed from the side. The amount of bow of the edge protective frame depends upon the shrinkage rate of the material used to mold the channel.

In the molding operations, the frame is placed into the mold and the channel material is then added. As the channel material cures it shrinks, pulling on the edge protective frame. Since the edge protective frame is made of steel, it cannot shrink, but instead is pulled inward toward the channel. This action forces the edge protective frame straight. If the frame were not bowed before the molding operation, it would bow out of shape during curing and result in an unacceptable channel assembly.

The present invention thus provides a drainage channel, the body of which is U-shaped, having complementary ends which, in abutting relation, form-interlock when joining a plurality of such channel bodies together. The channel body is provided with an edge protective frame device for the free top rims or edges of the channel side walls formed of a web resting on top of the side wall and two generally parallel anchor legs extending downwards from the web and being linked by the web and proceeding in the same direction and distance, at least one of which legs is flush with its respective side wall and between the two of which the material of the upper part of the channel side walls is formed. The frame further includes a mounting leg for a channel cover, extending upwards from the outer edge of the web. The channel has skewed or diagonal surface sections within the abutting surfaces of the side walls which permit adjacent channel units to fit; i.e. with adjacent surfaces forming an interlocking arrangement.

Described in further detail, the drainage channel has skewed surfaces (18, 19) at one end of the channel body (10) between two surfaces which are positioned vertically to the channel body axis (17, 20), the inner surface 20 of which is recessed with regard to the outer surface 17. The skewed surfaces 18 and 19 form a cone-like configuration which is inwardly directed towards the interior of the channel. At the other end of the channel skewed surfaces (16) are sloped from the front protruding portion 15 towards the outside of the channel walls 11 and 12 and form a cone-like configuration complementary towards the cone-like configuration at the opposite end. Protruding surface (15) which is vertical to the channel body axis abuts with the inner recessed surface (20) of the next adjacent channel (10).

The protective frame device (23) is fabricated from formed sheet metal that is bent in a folded manner 25, thus creating a double layer mounting leg 26, from which a web (27) and an inner anchor leg (28) are shaped by folding. Preferably, inward anchor tongues (24) are formed into the anchor legs (28, 29) which are most desirably tilted in an upwardly direction.

It is further desirable for recesses (31) to be formed at the end of the bottom edges of the inner anchor legs (28).

In fabricating the protective frame device, it is desirable to have sheet metal web (27) curved or bent at right angles with the longitudinal axis of the channel.

Further modifications and variations of the claimed invention will be apparent to those skilled in the art from a reading of the foregoing and are intended to be encompassed by the claims appended hereto.

I claim:

1. An edge protective frame device adapted to be cast into the top edges of a drainage channel side walls, comprising a web adapted for resting on top of the side walls and two anchor legs extending downwards therefrom and linked by the web, proceeding in the same direction, one of said legs being an inner anchor leg, at least one of said legs being adapted to be flush with its respective side wall of the channel and between the two of which legs there is space to accommodate the respective upper part of the channel side walls, said device having a mounting leg extending upwardly from the outer edge of the web and adapted to retain a channel cover, said device being formed of sheet metal bent in a folded manner (25) thereby creating a double layer mounting leg (26), said web and said inner anchor leg being shaped by folding.

2. The edge protective frame device according to claim 1, further comprising inward anchor tongues (24) being formed into the anchor legs (28, 29).

3. The edge protective frame device according to claim 2, wherein anchor tongues (24) being tilted upwards.

4. The edge protective frame device according to claim 1, wherein recesses (31) are present at the end of the bottom edges of the inner anchor legs (28).

5. The edge protective frame device according to claim 1, wherein a sheet metal web (27) is curved around a line which is at right angles with the longitudinal axis.

6. The edge protective frame device according to claim 1, wherein the top edge is bowed a predetermined amount, along its longitudinal axis, to compensate for the shrinkage of the material used to mold the channel, and is capable of bending to a straight shape after the channel has cured.

* * * * *